US011393445B2

(12) United States Patent
Mirshekarloo et al.

(10) Patent No.: US 11,393,445 B2
(45) Date of Patent: Jul. 19, 2022

(54) NOISE MANAGEMENT SYSTEM, A WINDOW SYSTEM AND RELATED METHODS

(71) Applicant: AGENCY FOR SCIENCE, TECHNOLOGY AND RESEARCH, Singapore (SG)

(72) Inventors: Meysam Sharifzadeh Mirshekarloo, Singapore (SG); Kui Yao, Singapore (SG); Mojtaba Rahimabady, Singapore (SG); Chin Yaw Tan, Singapore (SG)

(73) Assignee: AGENCY FOR SCIENCE, TECHNOLOGY AND RESEARCH, Singapore (SG)

( * ) Notice: Subject to any disclaimer, the term of this patent is extended or adjusted under 35 U.S.C. 154(b) by 0 days.

(21) Appl. No.: 17/268,782

(22) PCT Filed: Aug. 23, 2019

(86) PCT No.: PCT/SG2019/050418
§ 371 (c)(1),
(2) Date: Feb. 16, 2021

(87) PCT Pub. No.: WO2020/040702
PCT Pub. Date: Feb. 27, 2020

(65) Prior Publication Data

US 2021/0193105 A1 Jun. 24, 2021

(30) Foreign Application Priority Data

Aug. 23, 2018 (SG) ..... 10201807183R

(51) Int. Cl.
*G10K 11/16* (2006.01)
*G10K 11/178* (2006.01)
(Continued)

(52) U.S. Cl.
CPC ..... *G10K 11/17861* (2018.01); *B06B 1/0688* (2013.01); *E06B 5/205* (2013.01);
(Continued)

(58) Field of Classification Search
CPC ..... G10K 11/17861; G10K 11/17857; G10K 11/17881; G10K 2210/118;
(Continued)

(56) References Cited

FOREIGN PATENT DOCUMENTS

CN 101852056 A 10/2010
CN 205823099 U * 12/2016
(Continued)

OTHER PUBLICATIONS

Written Opinion in SG Application No. 11202101492S dated Dec. 20, 2021, 6 pages.
(Continued)

*Primary Examiner* — Ammar T Hamid
(74) *Attorney, Agent, or Firm* — Marshall, Gerstein & Borun LLP

(57) ABSTRACT

A noise management system for a window includes an active noise control (ANC) module and a passive sound absorbing module. The ANC module is disposed in or adjacent a ventilation channel of the window and configured to substantially cancel low-frequency noise entering the ventilation channel. The passive sound absorbing module is disposed in or adjacent to the ventilation channel and configured to absorb both high-frequency noise entering the channel and harmonic sounds generated by the ANC module.

20 Claims, 7 Drawing Sheets

(51) Int. Cl.

| | |
|---|---|
| ***B06B 1/06*** | (2006.01) |
| ***E06B 5/20*** | (2006.01) |
| *E06B 3/46* | (2006.01) |
| *E06B 7/02* | (2006.01) |

(52) U.S. Cl.
CPC .. *G10K 11/17857* (2018.01); *G10K 11/17881* (2018.01); *E06B 3/4609* (2013.01); *E06B 7/02* (2013.01); *G10K 2210/118* (2013.01); *G10K 2210/12* (2013.01); *G10K 2210/3212* (2013.01)

(58) Field of Classification Search
CPC ..... G10K 2210/12; G10K 2210/3212; B06B 1/0688; E06B 5/205; E06B 3/4609; E06B 7/02
USPC ..... 381/71.1
See application file for complete search history.

(56) References Cited

FOREIGN PATENT DOCUMENTS

| | | | |
|---|---|---|---|
| WO | WO-2017/200490 | A1 | 11/2017 |
| WO | WO-2018/132075 | A1 | 7/2018 |

OTHER PUBLICATIONS

Search Report and Written Opinion in International Application No. PCT/SG2019/050418 dated Oct. 9, 2019, 8 pages.

* cited by examiner

NOISE MANAGEMENT SYSTEM, A WINDOW SYSTEM AND RELATED METHODS

FIELD OF INVENTION

The present invention relates broadly, but not exclusively, to a noise management system for a window, to a window system, to a method of managing noise and to a method of installing a noise management system on a window.

BACKGROUND

As "unwanted" sound, noise is one of the factors determining the quality of people's life. In buildings, windows constitute the main path through which noise enters a room. Therefore, the design of windows has a significant impact on noise levels at different parts of a room or building. In addition, windows should be transparent, able to provide fresh air and enable natural ventilation into a building. When the noise level outside is high, closing the windows to reduce noise will cut off natural ventilation. Reducing noise transmission through windows while retaining natural ventilation function can contribute to achieving acoustic comfort and fresh air circulation for a room in noisy environments, such as high density urban areas with heavy traffic.

A double-layered window with staggered openings is one of the conventional designs to reduce noise transmission through window while retaining ventilation function. Embedding passive sound absorbing materials within a ventilation channel can lead to high frequency sound absorption. However, the passive sound absorbing technologies typically do not work effectively at low audible frequency range, which often occupies a large portion of the noise in urban environment.

In contrast to passive sound absorbers, active noise mitigation technologies are more effective at low frequencies. For example, a recently disclosed ventilation window structure adopts a multi-cell transparent electroactive film speaker for achieving active noise control (ANC) function. However, speakers generating the anti-phase secondary cancellation sound usually produce high frequency harmonic distortion, which is the case of the multi-cell transparent electroactive film speakers. The harmonic sound would exist as additional noise and would also disturb ANC operation, resulting in noise mitigation performance degradation.

A need therefore exists to provide a noise management system for a window that seeks to address at least some of the above problems.

SUMMARY

According to a first aspect, there is provided a noise management system for a window, the system comprising: an active noise control (ANC) module disposed in or adjacent a ventilation channel of the window and configured to substantially cancel low-frequency noise entering the ventilation channel; and a passive sound absorbing module disposed in or adjacent to the ventilation channel and configured to absorb both high-frequency noise entering the channel and harmonic sounds generated by the ANC module.

The ANC module and passive sound absorbing module in the present system can synergistically interact with each other, and the performance of ANC can be improved with the harmonic sounds from the ANC module being absorbed by the passive sound absorbing module. Advantageously, the overall noise mitigation performance with the combined ANC module and passive sound absorbing module can be superior to the sum of ANC effect and passive absorbing effect, separately.

The ANC module may comprise at least one multi-cell transparent electroactive film speaker comprising a plurality of electroactive cells, and each cell may be individually operable for generating a sound signal anti-phase to the low-frequency noise.

Each electroactive cell may comprise a transparent electroactive film, a transparent substrate, a transparent bottom electrode and a transparent top electrode.

The transparent electroactive film may comprise a transparent piezoelectric polymer or a transparent electroactive polymer.

The transparent piezoelectric polymer may comprise polyvinylidene fluoride (PVDF) or polyvinylidene fluoride-trifluoroethylene (P(VDF-TrFE)).

The transparent electroactive polymer may comprise an electret or a dielectric elastomer.

At least one of the transparent top and bottom electrodes may comprise a coating of a transparent conductive material selected from a group consisting of indium tin oxide (ITO), carbon nano-tube, carbon nano-bud, graphene, metal nanowires, and poly(3,4-ethylenedioxythiophene) polystyrene sulfonate (PEDOT:PSS).

The passive noise absorbing module may comprise mechano-electrical conversion elements and/or electro-thermal conversion elements.

The mechano-electrical conversion elements may comprise a piezoelectric polymer, a charge electret polymer, piezoelectric ceramic particles, or a combination thereof.

The piezoelectric polymer may comprise one selected from a group consisting of polyvinylidene fluoride (PVDF), polyvinylidene fluoride-trifluoroethylene (P(VDF-TrFE)), polyvinylidene fluoride-co-hexafluoropropylene (P(VDF-HFP)), and the charge electret polymer may comprise one selected from a group consisting of polypropylene, polyethylene terephthalate, polytetrafluoroethylene, polyimide, polymethylmethacrylate, or ethylene vinyl acetate cyclic olefin.

The electro-thermal conversion elements may comprise a conductive material or a lossy material.

The conductive material may comprise one selected from a group consisting of carbon nanotubes (CNT), graphene, carbon black, and conductive metal particles.

The lossy material may comprise one selected from a group consisting of aluminum nitrate nonahydrate ($Al(NO_3)_3 9H_2O$), aluminum chloride hexahydrate ($AlCl_3 6H_2O$), tetra-n-butylammonium chloride (TBAC), and ammonium acetate ($NH_4OAc$).

The mechano-electrical conversion elements and electro-thermal conversion elements may form a porous composite having a volume porosity of at least 85%.

The passive sound absorbing module may be capable of absorbing sounds having a frequency below 1 kHz.

The passive sound absorbing module may comprise a sound absorbing material having a sound absorption coefficient greater than 0.5 at frequencies above 600 Hz.

The sound absorbing material may have a sound absorption coefficient greater than 0.8 at a frequency of approximately 1 kHz.

According to a second aspect, there is provided a window system comprising at least one noise management system as defined in the first aspect.

The ANC module of the window system may comprise a plurality of multi-cell transparent electroactive film speakers spatially disposed at different locations along the ventilation channel.

The window of the window system may comprise a lower part having a lower ventilation channel and an upper part having an upper ventilation channel, and an ANC module may be disposed in or adjacent each of the lower and upper ventilation channels, and a passive sound absorbing module may be disposed in or adjacent each of the lower and upper ventilation channels.

The noise management system may be configured to provide a noise reduction index of at least 15 dB.

According to a third aspect, there is provided a method of managing noise, comprising: substantially cancelling low-frequency noise entering a ventilation channel of a window using an active noise control (ANC) module disposed in or adjacent the ventilation channel; absorbing high-frequency noise entering the channel using a passive sound absorbing module disposed in or adjacent to the ventilation channel; and absorbing harmonic sounds generated by the ANC module using the passive sound absorbing module.

The method of managing noise may further comprise detecting the low-frequency noise using a reference microphone before substantially cancelling the low-frequency noise.

The ANC module may comprise at least one multi-cell transparent electroactive film speaker comprising a plurality of electroactive cells, and substantially cancelling the low-frequency noise may comprise individually operating each cell to generate a sound signal anti-phase to the low-frequency noise based on the detection.

The method of managing noise may further comprise detecting a remaining noise after the absorption and adjusting the ANC module based on the detected remaining noise.

Absorbing the harmonic sounds generated by the ANC module using the passive sound absorbing module may comprise absorbing sounds having a sound absorption coefficient greater than 0.8 at a frequency of approximately 1 kHz According to a fourth aspect, there is provided a method of installing a noise management system on a window, the method comprising: disposing an active noise control (ANC) module in or adjacent a ventilation channel of the window, wherein the ANC module is configured to substantially cancel low-frequency noise entering the ventilation channel; and disposing a passive sound absorbing module in or adjacent to the ventilation channel, wherein the passive sound absorbing module is configured to absorb both high-frequency noise entering the channel and harmonic sounds generated by the ANC module.

The ANC module may comprise a plurality of multi-cell transparent electroactive film speakers, and disposing the ANC module may comprise spatially distributing the speakers at different locations along the ventilation channel.

The window may comprise a lower part having a lower ventilation channel and an upper part having an upper ventilation channel, and an ANC module may be disposed in or adjacent each of the lower and upper ventilation channels, and a passive sound absorbing module may be disposed in or adjacent each of the lower and upper ventilation channels.

BRIEF DESCRIPTION OF THE DRAWINGS

Embodiments of the invention will be better understood and readily apparent to one of ordinary skill in the art from the following written description, by way of example only, and read in conjunction with the drawings, in which.

DETAILED DESCRIPTION

Figure 1:
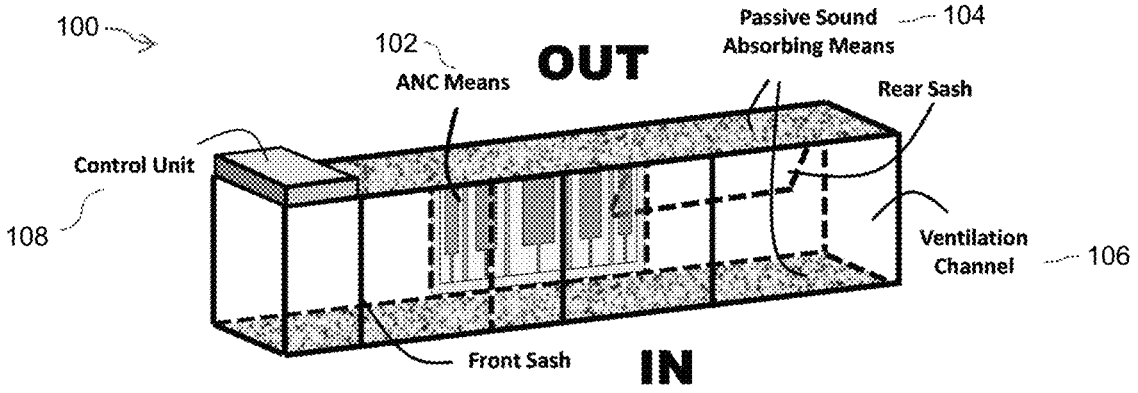
FIG. 1 is a schematic representation of a noise management window, according to an example embodiment.

Embodiments will be described, by way of example only, with reference to the drawings. Like reference numerals and characters in the drawings refer to like elements or equivalents.

Embodiments of the invention provide a window with natural ventilation and combined passive and active noise mitigation functions effective over a broad audible frequency range. The window as disclosed herein may comprise at least a ventilation channel, an ANC module in the ventilation channel to cancel low frequency noise, and a passive sound absorbing module in the ventilation channel to absorb high frequency noise. The ANC module comprises a transparent electroactive film speaker, preferably comprising a plurality of electroactive cells, to generate cancelling sound, which is a secondary sound with anti-phase to cancel the incident noise which is the primary sound.

A control unit, comprising a reference microphone, an analog to digital converter (ADC), a digital signal processing (DSP) unit, a digital to analog converter (DAC), a power amplifier and an error microphone, may control the transparent electroactive film speaker and its multiple cells, for achieving the ANC function.

The passive sound absorbing module comprises a material that absorbs sound. Preferably, the sound absorbing material has a large sound absorption coefficient, even at a low frequency below 1 kHz. To achieve such a performance, the sound absorbing material may be porous, and may comprise mechano-electrical conversion elements (such as piezoelectric polymers or polymeric electrets) and electro-thermal conversion elements (such as electrical conductive or dielectric lossy elements). The ANC module and passive sound absorbing module interact with each other and the overall noise mitigation performance with the combined active and passive module can be superior to the sum of ANC effect and passive absorbing effect separately. In addition to absorbing the high frequency primary sound, the passive sound absorbing module absorbs the high order harmonic sounds generated by the ANC module, i.e. the transparent electroactive film speaker. Such high order harmonic sounds would otherwise interfere with the control unit and may seriously reduce ANC efficiency and even cause its instability and failure. The synergistic functions of the passive sound absorbing module and ANC module employing the multi-cell transparent electroactive film speaker may result in unprecedented window design feature with superior noise mitigation performance over a broad frequency range.

FIG. 1 is a schematic representation of a noise management system 100 for a window, according to an example embodiment. The noise management system for a window comprises at least an active noise control (ANC) module 102 disposed in or adjacent a ventilation channel 106 of the window and configured to substantially cancel low-frequency noise entering the ventilation channel 106. The noise management system 100 also comprises a passive sound absorbing module 104 disposed in or adjacent to the ventilation channel 106 and configured to absorb both high-frequency noise entering the channel 106 and harmonic sounds generated by the ANC module 102. A control unit 108 is connected to the ANC module 102 to control the function of the ANC module 102.

The ANC module 102 is more effective in cancelling low frequency noise (such as below 600 Hz) and the passive sound absorbing module 104 is more effective in absorbing high frequency noise (such as above 600 Hz).

Figure 2:
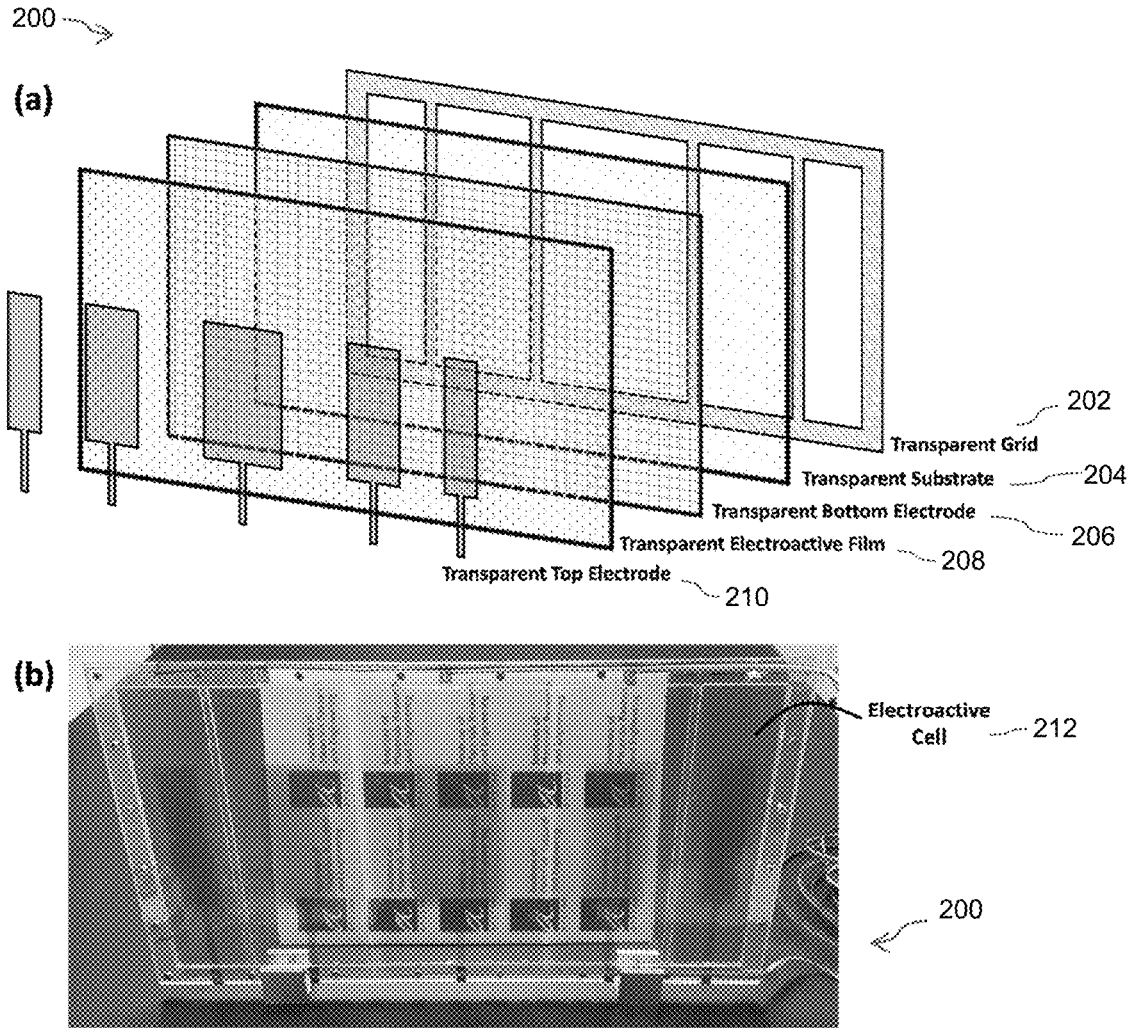
FIG. 2, comprising FIGS. 2(*a*) and 2(*b*), shows an exploded view of an example of a multi-cell transparent electroactive film speaker and an example of a fabricated multi-cell transparent electroactive film speaker, according to an example embodiment.

FIG. 2, comprising FIGS. 2(*a*) and 2(*b*), shows an exploded view of an example of a multi-cell transparent electroactive film speaker 200 and an example of a fabricated multi-cell transparent electroactive film speaker 200, according to an example embodiment.

The ANC module 102 (FIG. 1) may comprise at least one multi-cell transparent electroactive film speaker 200 comprising a plurality of individually operable electroactive cells 212, wherein each cell 212 can be controlled individually for generating a cancelling sound signal anti-phase to the low-frequency noise.

Each electroactive cell 212 of the multi-cell transparent electroactive film speaker 200 may comprise a transparent electroactive film 208, such as a piezoelectric film, a transparent substrate 204, a transparent bottom electrode 206, a transparent top electrode 210, and a transparent grid 202. The transparent electroactive film 208 of the multi-cell transparent electroactive film speaker 200 may be fabricated from a transparent piezoelectric polymer with sufficiently high piezoelectric strain coefficients, including but not limited to polyvinylidene fluoride (PVDF), polyvinylidene fluoride-trifluoroethylene (P(VDF-TrFE)). The transparent electroactive film 208 of the multi-cell transparent electroactive film speaker 200 may also be fabricated from a transparent electroactive polymer including but not limited to electrets and dielectric elastomers. The transparent top electrode 210 and bottom electrode 206 may be fabricated by coating a transparent conductive material, including but not limited to indium tin oxide (ITO), carbon nano-tube, graphene, metal nano-wires, poly(3,4-ethylenedioxythiophene) polystyrene sulfonate (PEDOT:PSS), on the transparent electroactive film 208.

The control unit 108 (FIG. 1) controlling the ANC module 102 may comprise a reference microphone, an analog to digital converter (ADC), a digital signal processing (DSP) unit, a digital to analog converter (DAC), a power amplifier, and an error microphone, in which the control system may generate single or multiple control signals for driving the multiple electroactive cells 212 of the multi-cell transparent electroactive film speaker 200 to generate the cancelling noise.

An incident noise as the primary sound entering the ventilation channel 106 can be sensed by the reference microphone. The ANC control unit 108 may convert the input analog primary noise signal to digital format data which is processed by the DSP, based on a digital signal processor or field programmable gate array (FPGA), based on Filter-X Least Mean Square (FXLMS) adaptive algorithm, to generate a suitable digital output signal to be fed to the DAC to produce an analog signal to control the multi-cell transparent electroactive film speaker 200 for generating the secondary sound as the cancelling noise of anti-phase with the incident noise. The destructive interaction of the primary sound and the secondary sound within the ventilation channel 106 may result in reduced noise transmitted through the window at a low frequency range. The residual noise measured by the error microphone can be used as the active feedback for adjusting the phase as well as sound pressure level of the cancelling noise for optimizing the ANC effect.

Compared to the conventional electromagnetic speakers, multi-cell transparent electroactive film speakers 200 may have higher harmonic distortion. When the multi-cell transparent electroactive film speaker 200 is driven at a certain frequency, it may generate harmonic sounds at higher frequencies. The present inventors have noted that the excessive harmonic sound generated due to the harmonic distortion of the multi-cell transparent electroactive film speaker 200 may be picked up by the reference and error microphones which may cause interference or error to the control unit 108 of the ANC module 102, hence the ANC module 102 may fail in effectively cancelling the noise or may experience instability and failure.

Figure 3:
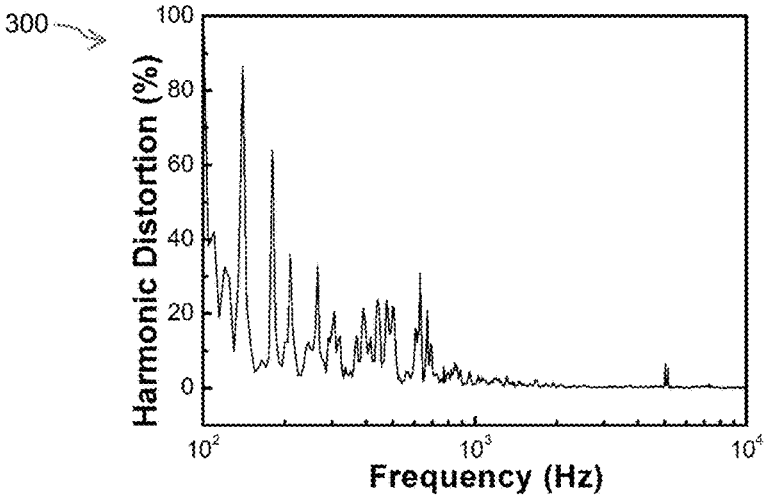
FIG. 3 is a chart illustrating harmonic distortion of a multi-cell transparent electroactive film speaker.

FIG. 3 is a graph 300 illustrating harmonic distortion of a typical multi-cell transparent electroactive film speaker.

Figure 4:
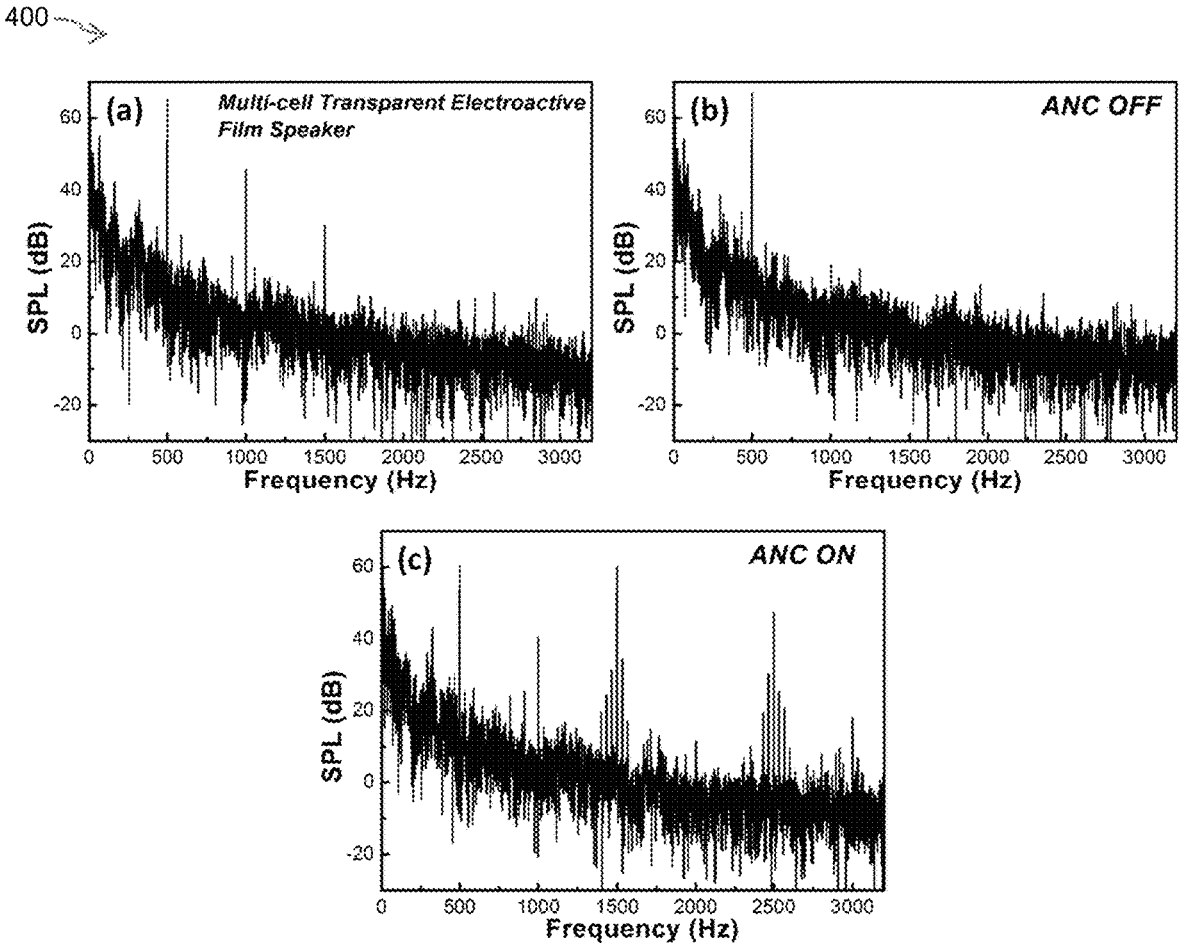
FIG. 4, comprising FIGS. 4(*a*) to 4(*c*), shows an example of failure in noise mitigation in a window employing only the ANC means using a transparent electroactive film speaker.

FIG. 4, comprising FIGS. 4(*a*) to 4(*c*), shows an example of failure in noise mitigation in a window 400 employing only the ANC means using a transparent electroactive film speaker. FIG. 4(*a*) shows harmonic sounds generated by a typical multi-cell transparent electroactive film speaker when driven at 500 Hz. FIG. 4(*b*) shows the measured noise when ANC is OFF (i.e. only primary sound) and FIG. 4(*c*) shows the measured noise when ANC is ON. The typical multi-cell transparent electroactive film speaker may generate significant second and third harmonic components when it is driven at 500 Hz as shown in FIG. 4(*a*). When ANC is OFF, the primary sound has a pure 500 Hz component as shown in FIG. 4(*b*). By turning ON the ANC, although the 500 Hz noise is reduced by about 6 dB, excessive higher frequency components are generated by the multi-cell transparent electroactive film speaker, the overall noise increases and the ANC fails completely as shown in FIG. 4(*c*).

According to the example embodiment, the passive sound absorbing module 104 is disposed in the ventilation channel 106. The passive sound absorbing module 104 can perform two functions: absorb the high frequency primary sound travelling in the ventilation channel 106 of the window, and substantially absorb the harmonic sounds generated by the multi-cell transparent electroactive film speaker 200, thereby reducing the error introduced to the ANC control unit 108, avoiding its instability and failure, and increasing its noise reduction efficiency.

The passive sound absorbing module 104 of the example embodiment preferably exhibits a large sound absorption coefficient even at low frequency below 1 kHz. To achieve such a performance at frequency below 1 kHz, the sound absorbing module 104 can be porous and comprise mechano-electrical conversion elements and/or electro-thermal conversion elements.

The mechano-electrical conversion elements may be selected from any piezoelectric and charge electret polymer including but not limited to polyvinylidene fluoride (PVDF), polyvinylidene fluoride-trifluoroethylene (P(VDF-TrFE)), polyvinylidene fluoride-co-hexafluoropropylene (P(VDF-HFP)), polypropylene, polyethylene terephthalate, polytetrafluoroethylene, polyimide, polymethylmethacrylate, or ethylene vinyl acetate cyclic olefin or any other hybrid and blend of these polymers with other polymers, or piezoelectric ceramic particles. The electro-thermal conversion elements may be selected from any conductive material including but not limited to carbon nanotubes (CNT), graphene, carbon black, and conductive metal particle, or lossy material including but not limited to hydrated or hygroscopic materials such as aluminum nitrate nonahydrate ($Al(NO_3)_3 9H_2O$), aluminum chloride hexahydrate ($AlCl_3 6H_2O$), tetra-n-butylammonium chloride (TBAC), and ammonium acetate ($NH_4OAc$). The porosity of the passive sound absorbing module is in range of 50% to 95%, preferably larger than 85%, and the pore size is preferably in the range of 50 μm to 600 μm. For example, the mechano-electrical conversion elements and electro-thermal conversion elements may form a porous composite having a volume porosity of at least 85%.

More preferably, the passive sound absorbing module 104 is porous and comprises a composite of PVDF and 5 wt % CNT. Table 1 shows sound absorption coefficients of a passive sound absorbing module comprising a porous composite of polyvinylidene fluoride (PVDF) and 5 wt % carbon nanotubes (CNT), in comparison with several commonly used sound absorbing materials.

TABLE 1

| Frequency | Sound Absorption Coefficient | | | |
|---|---|---|---|---|
| (Hz) | PVDF/5 wt % CNT | Cotton Fiber | Polyurethane | Rockwool |
| 200 | 0.08 | 0.06 | 0.06 | 0.06 |
| 400 | 0.30 | 0.12 | 0.12 | 0.10 |
| 600 | 0.54 | 0.20 | 0.22 | 0.18 |
| 800 | 0.74 | 0.29 | 0.33 | 0.32 |
| 1000 | 0.87 | 0.39 | 0.46 | 0.41 |
| 1200 | 0.94 | 0.48 | 0.58 | 0.61 |
| 1400 | 0.98 | 0.58 | 0.69 | 0.92 |
| 1600 | 0.99 | 0.67 | 0.79 | 0.95 |

Compared to the commercially available sound absorbing materials, the passive sound absorbing module 104 comprising a composite of PVDF and 5 wt % CNT exhibits much larger sound absorption coefficient in a wide frequency range, even up to relatively lower frequencies (below 1 kHz). For example, the sound absorbing material forming the passive sound absorbing module 104 may have a sound absorption coefficient greater than 0.5 at frequencies above 600 Hz, preferably a sound absorption coefficient greater than 0.8 at a frequency of approximately 1 kHz. The higher sound absorption coefficient of the passive sound absorbing module 104 over a broad frequency range with the low frequency end extended below 1 kHz is critical to absorbing the harmonic sounds of the multi-cell transparent electroactive film speaker 200 during ANC operation.

Figure 5:
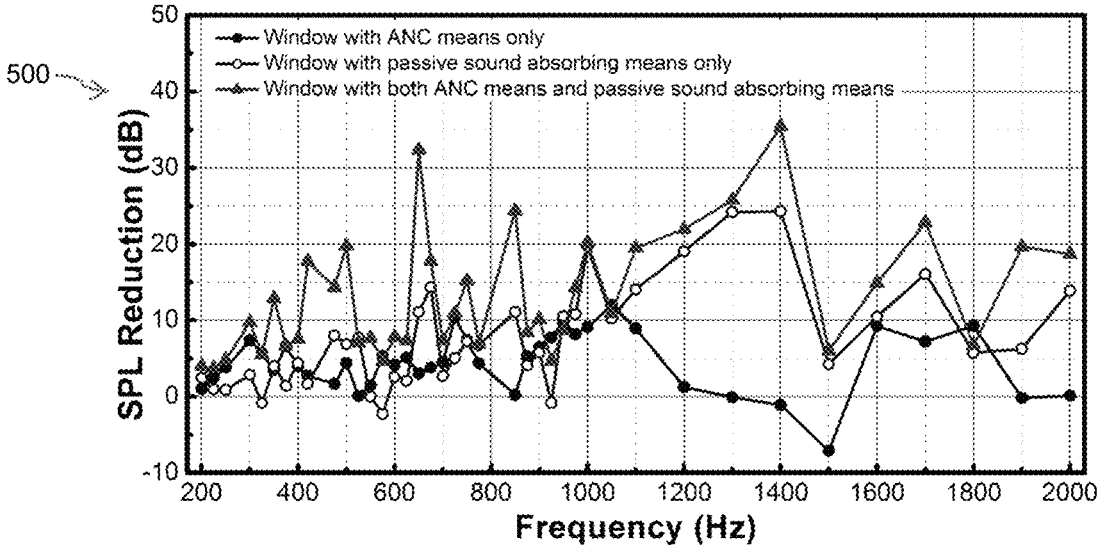
FIG. 5 shows example sound pressure level (SPL) reduction of a window with three different noise mitigation designs in the ventilation channel.

When the incident noise enters the ventilation channel 106 of the window, high frequency noise may be absorbed by the passive sound absorbing module 104 and low frequency noise is cancelled by the ANC module 102. Furthermore, the passive sound absorbing module 104 may absorb the harmonic sounds generated by the multi-cell transparent electroactive film speaker 200, and may substantially reduce the error introduced to the ANC control unit 108. Consequently ANC can become more effective. The synergistic interaction of the ANC module 102 and the passive sound absorbing module 104 can result in a significantly improved overall noise mitigation performance of the window in a broad audible frequency range. FIG. 5 shows plots illustrating example sound pressure level (SPL) reduction of a window with three different noise mitigation designs in the ventilation channel 106. The three different noise mitigation designs are ANC module 102 only, passive sound absorbing module 104 only, and both ANC module 102 and passive sound absorbing module 104 according to the example embodiment.

The window with the synergistic interaction from both the ANC module 102 and the passive sound absorbing module 104 can have a significantly improved noise mitigation performance in a wider frequency range compared to the windows with only one of them. The passive sound absorbing module 104 not only can absorb some of the noise but can also improve the performance of the ANC module 102 by absorbing the harmonic sounds generated by the ANC module 102. The SPL reduction of the window with the combined two modules according to the present embodiments is even much larger than the sum of SPL reduction of the window only with the ANC module 102 and with the passive sound absorbing module 104, separately. The window with the noise management system as described can have a noise reduction index of at least 15 dB.

Noise reduction index (NRI) is defined in Equation 1 below:

$$NRI = \frac{\Delta SPL_{250} + \Delta SPL_{500} + \Delta SPL_{1000} + \Delta SPL_{2000}}{4} \quad (1)$$

where ΔSPL is the sound pressure level reduction. The window according to an embodiment has a significantly larger NRI of 15.9 dB compared to 3.4 dB of the window only with ANC module 102 and 10.3 dB of the window only with passive sound absorbing module 104, noting that the unit is on logarithmic scale.

In one implementation, the transparent top electrode 210 of the transparent electroactive film speaker 200 can be patterned in the shape of flowers to improve aesthetics.

Embodiments of the invention also provide a window system comprising at least one noise management system as described above.

Figure 6:
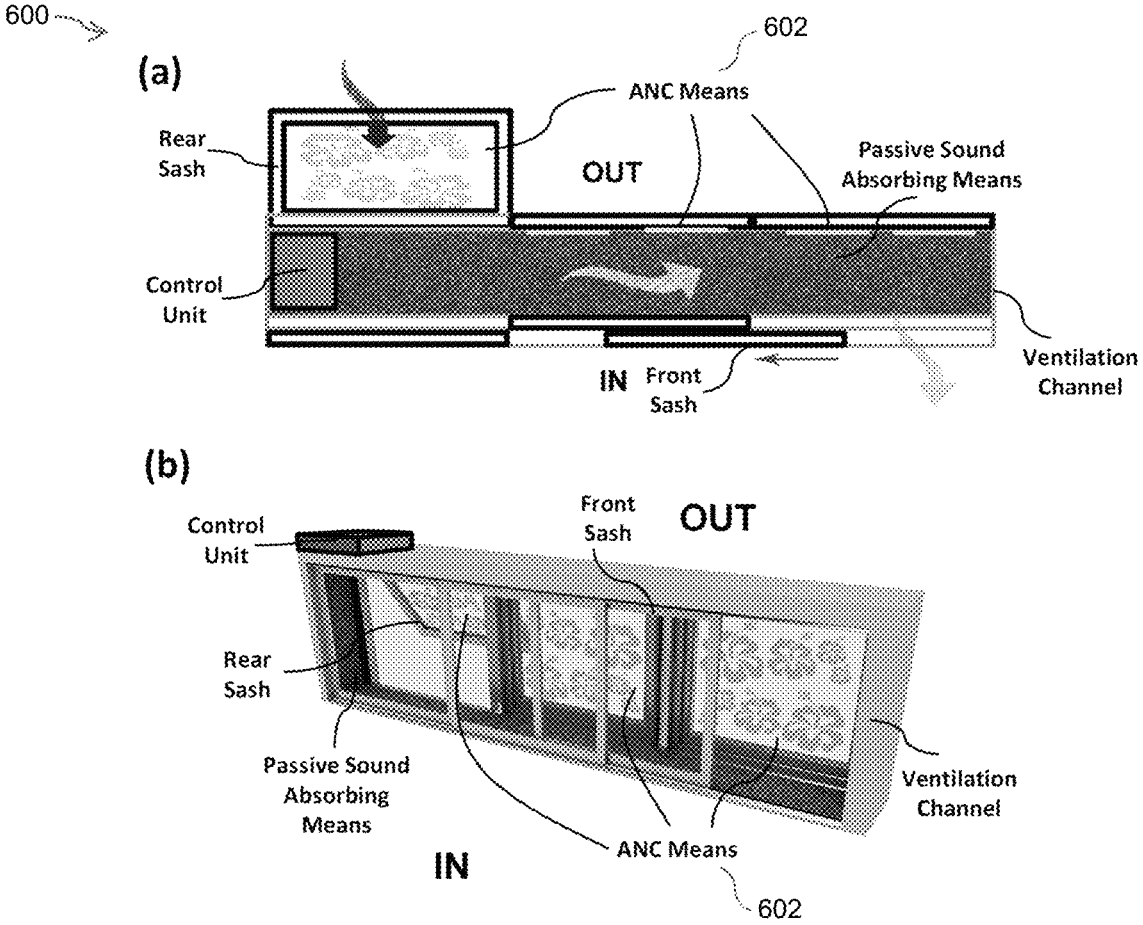
FIG. 6, comprising FIGS. 6(*a*) and 6(*b*), is a schematic representation of a window having ANC module comprising multiple transparent electroactive film speakers, according to another example embodiment.

FIG. 6, comprising FIGS. 6(*a*) and 6(*b*), is a schematic representation 600 of a window having ANC module 602 comprising multiple transparent electroactive film speakers, according to an example embodiment. FIG. 6(*a*) depicts a top view and FIG. 6(*b*) depicts a perspective view of the window. Such window may be capable of achieving larger SPL reductions and more uniform noise mitigation performance.

Figure 7:
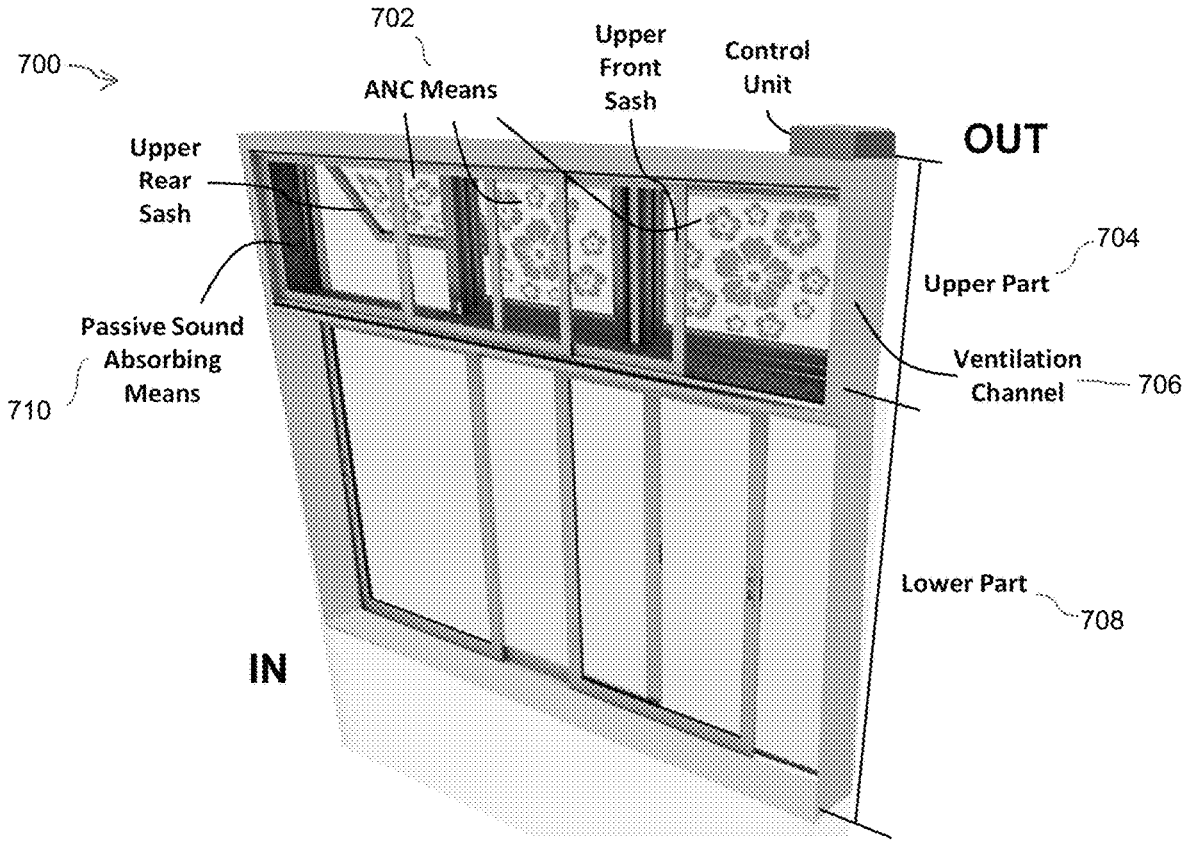
FIG. 7 is a schematic representation of a window comprising split upper and lower parts, according to another example embodiment.

FIG. 7 is a schematic representation of a window 700 comprising split upper and lower parts 704, 708, according to another example embodiment. The lower part 708 can be a conventional window without ventilation channel. The upper part 704 can have a ventilation channel 706 with an ANC module 702 and a passive sound absorbing module 710.

Figure 8:
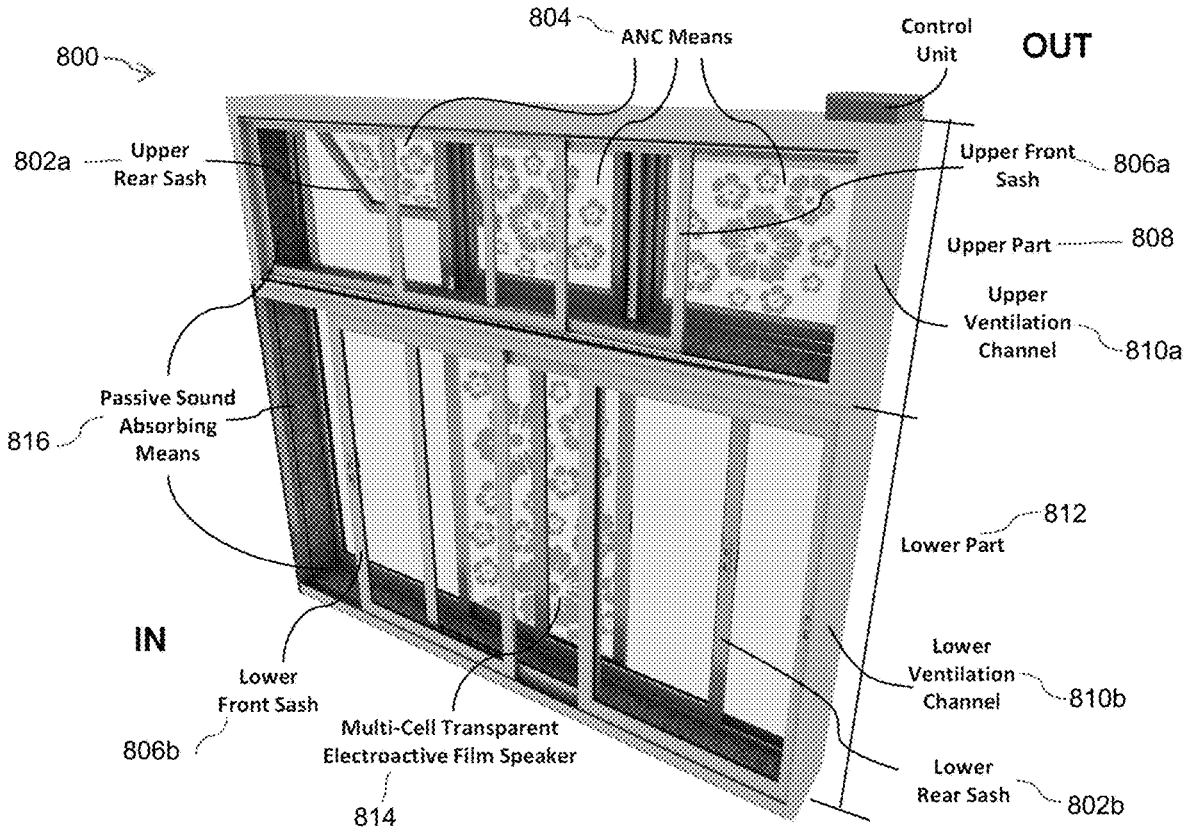
FIG. 8 is a schematic representation of a window comprising split upper and lower parts, and both the upper and lower parts have a ventilation channel between a plurality of front and rear sashes, according to another example embodiment.

FIG. 8 is a schematic representation of a window 800 comprising split upper and lower parts 808, 812, and the upper and lower parts 808, 812 have respective ventilation channels 810*a*, 810*b* between a plurality of front sashes 806*a*, 806*b* and rear sashes 802*a*, 802*b*, according to another example embodiment. In one implementation, the window 800 can have an ANC module 804 comprising four multi-cell transparent electroactive films speakers 814, three in the ventilation channel 810*a* of the upper part 808 and one in the ventilation channel 810*b* of the lower part 812. Top, bottom and side walls of ventilation channel 810*a*, 810*b* of both the upper and lower parts 808, 812 are covered with the passive sound absorbing modules 816. Compared to the other embodiments, the window 800 allows more ventilation as well as effective noise mitigation performance.

Figure 9:
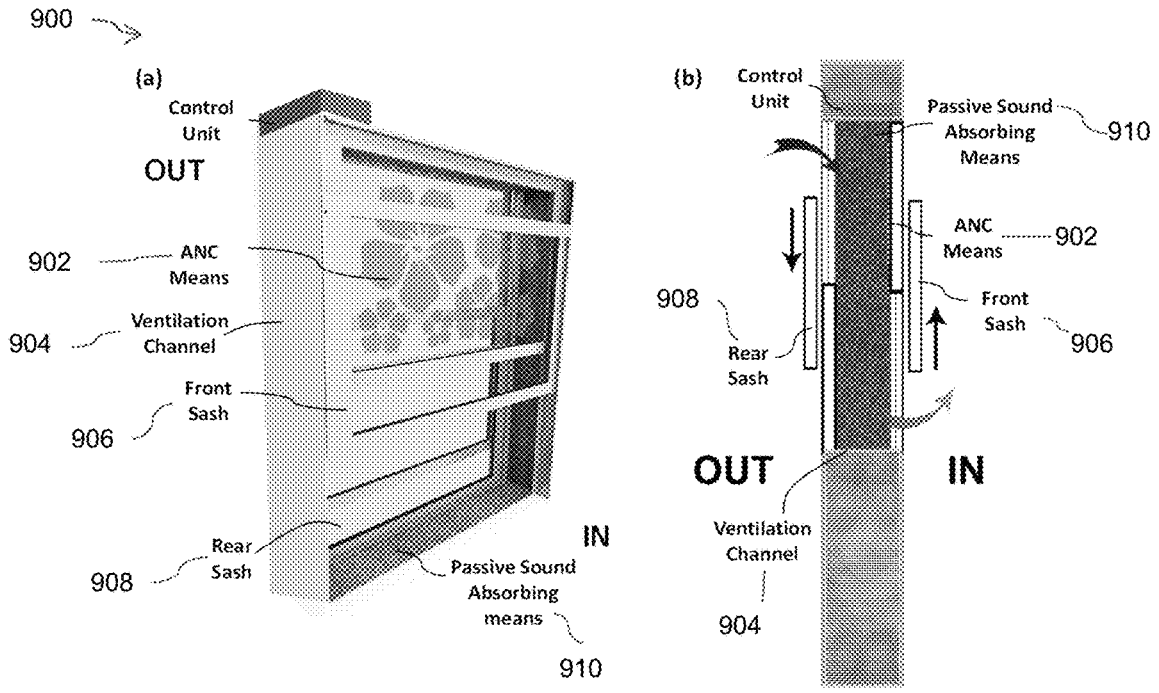
FIG. 9, comprising FIGS. 9(*a*) and 9(*b*), is a schematic representation of a window comprising a ventilation channel between a front and a rear single hung sash, an ANC module and a passive sound absorbing module in the ventilation channel, according to another example embodiment.

FIG. 9, comprising FIGS. 9(*a*) and 9(*b*), is a schematic representation of a window 900 comprising a ventilation channel 904 between a front and a rear single hung sash 906, 908, an ANC module 902 and a passive sound absorbing module 910 in the ventilation channel 904, according to another example embodiment. FIG. 9(*a*) shows a perspective view and FIG. 9(*b*) shows a cross section view. The front and rear single hung sashes 906, 908 of the window 900 may be configured to move upward and downward.

Figure 10:
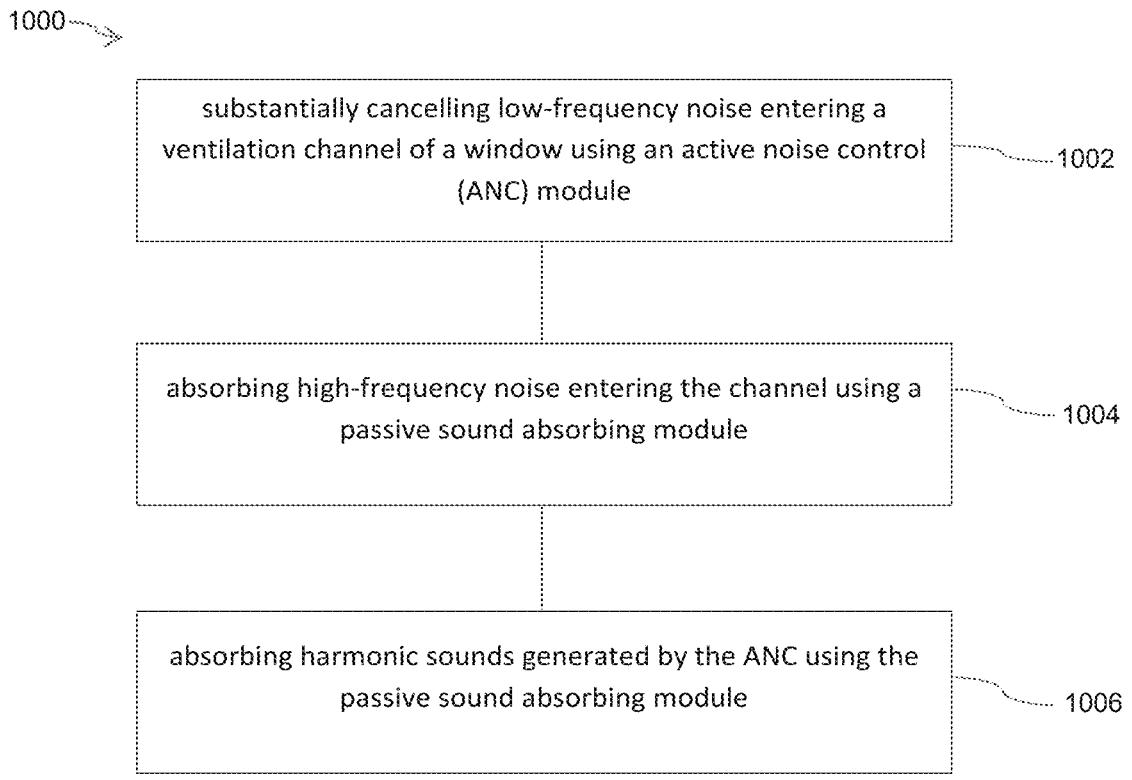
FIG. 10 is a flowchart illustrating a method of managing noise according to an example embodiment.

FIG. 10 is a flowchart 1000 illustrating a method of managing noise according to an example embodiment. At step 1002, low-frequency noise entering a ventilation channel of a window is substantially cancelled using an active noise control (ANC) module disposed in or adjacent the ventilation channel. At step 1004, high-frequency noise entering the channel is absorbed using a passive sound absorbing module disposed in or adjacent to the ventilation channel. At step 1006, harmonic sounds generated by the ANC is absorbed using the passive sound absorbing module. Step 1006 may comprise absorbing sounds having a frequency below 1 kHz.

Figure 11:
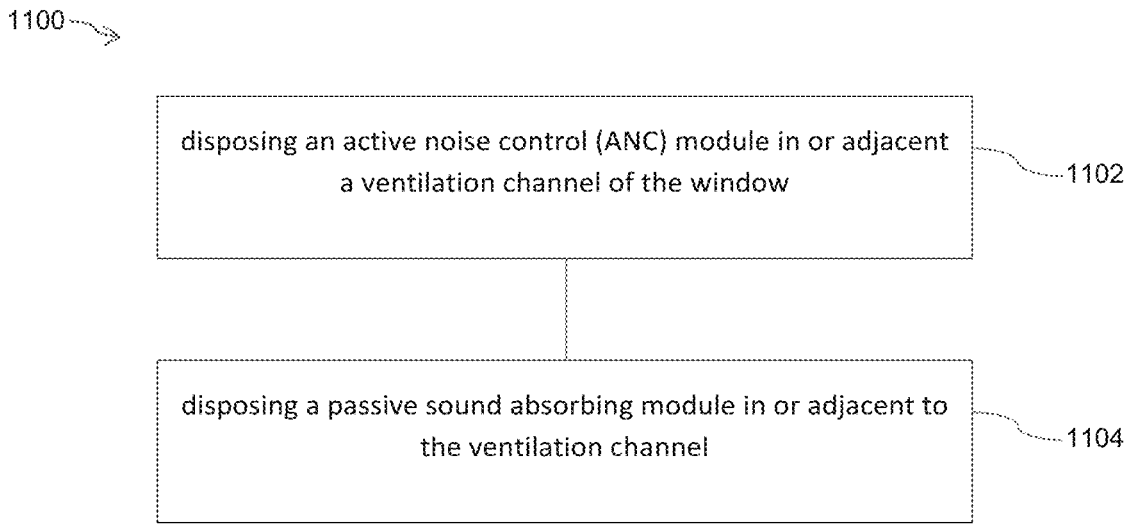
FIG. 11 is a flowchart illustrating method of installing a noise management system on a window according to an example embodiment.

FIG. 11 is a flowchart 1100 illustrating a method of installing a noise management system on a window according to an example embodiment. At step 1102, an active noise control (ANC) module is disposed in or adjacent a ventilation channel of the window. The ANC module is configured to substantially cancel low-frequency noise entering the ventilation channel. At step 1104, a passive sound absorbing module is disposed in or adjacent to the ventilation channel. The passive sound absorbing module is configured to absorb both high-frequency noise entering the channel and harmonic sounds generated by the ANC module.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. A noise management system for a window, the system comprising:

an active noise control (ANC) module disposed in or adjacent to a ventilation channel of the window and configured to substantially cancel low-frequency noise entering the ventilation channel; and a passive sound absorbing module disposed in or adjacent to the ventilation channel and configured to absorb both high-frequency noise entering the ventilation channel and harmonic sounds generated by the ANC module, wherein the ANC module comprises at least one multi-cell transparent electroactive film speaker comprising a plurality of electroactive cells, and wherein each cell is individually operable for generating a sound signal anti-phase to the low-frequency noise.

2. The noise management system as claimed in claim 1, wherein each electroactive cell comprises a transparent electroactive film, a transparent substrate, a transparent bottom electrode, and a transparent top electrode.

3. The noise management system as claimed in claim 2, wherein the transparent electroactive film comprises a transparent piezoelectric polymer or a transparent electroactive polymer.

4. The noise management system as claimed in claim 2, wherein at least one of the transparent top and bottom electrodes comprises a coating of a transparent conductive material selected from the group consisting of indium tin oxide (ITO), carbon nano-tube, carbon nano-bud, graphene, metal nano-wires, and poly(3,4-ethylenedioxythiophene) polystyrene sulfonate (PEDOT:PSS).

5. A noise management system for a window, the system comprising:

an active noise control (ANC) module disposed in or adjacent to a ventilation channel of the window and configured to substantially cancel low-frequency noise entering the ventilation channel; and a passive sound absorbing module disposed in or adjacent to the ventilation channel and configured to absorb both high-frequency noise entering the ventilation channel and harmonic sounds generated by the ANC module, wherein the passive noise absorbing module comprises mechano-electrical conversion elements and/or electro-thermal conversion elements.

6. The noise management system as claimed in claim 5, wherein the mechano-electrical conversion elements comprise a piezoelectric polymer, a charge electret polymer, piezoelectric ceramic particles, or a combination thereof.

7. The noise management system as claimed in claim 6, wherein the piezoelectric polymer comprises one selected from a group consisting of polyvinylidene fluoride (PVDF), polyvinylidene fluoride-trifluoroethylene (P(VDF-TrFE)), polyvinylidene fluoride-co-hexafluoropropylene (P(VDF-HFP)), and wherein the charge electret polymer comprises one selected from a group consisting of polypropylene, polyethylene terephthalate, polytetrafluoroethylene, polyimide, polymethylmethacrylate, or ethylene vinyl acetate cyclic olefin.

8. The noise management system as claimed in claim 5, wherein the electro-thermal conversion elements comprise a conductive material or a lossy material.

9. The noise management system as claimed in claim 8, wherein the conductive material comprises one selected from the group consisting of carbon nanotubes (CNT), graphene, carbon black, and conductive metal particles.

10. The noise management system as claimed in claim 8, wherein the lossy material comprises one selected from the group consisting of aluminum nitrate nonahydrate ($Al(NO_3)_3 9H_2O$), aluminum chloride hexahydrate ($AlCl_3 6H_2O$), tetra-n-butylammonium chloride (TBAC), and ammonium acetate ($NH_4OAc$).

11. The noise management system as claimed in claim 5, wherein the mechano-electrical conversion elements and electro-thermal conversion elements form a porous composite having a volume porosity of at least 85%.

12. A window system comprising at least one noise management system as claimed in claim 1.

13. A method of managing noise, comprising:

detecting low-frequency noise entering a ventilation channel of a window using a reference microphone;

substantially cancelling the low-frequency noise using an active noise control (ANC) module disposed in or adjacent to the ventilation channel;

absorbing high-frequency noise entering the ventilation channel using a passive sound absorbing module disposed in or adjacent to the ventilation channel; and absorbing harmonic sounds generated by the ANC module using the passive sound absorbing module, wherein the ANC module comprises at least one multi-cell transparent electroactive film speaker comprising a plurality of electroactive cells, and wherein substantially cancelling the low-frequency noise comprises individually operating each cell to generate a sound signal anti-phase to the low-frequency noise based on the detection.

14. The method as claimed in claim 13, further comprising detecting a remaining noise after the absorption and adjusting the ANC module based on the detected remaining noise.

15. The method as claimed in claim 13, wherein absorbing the harmonic sounds generated by the ANC module using the passive sound absorbing module comprises absorbing sounds having a frequency below 1 kHz.

16. A method of installing a noise management system on a window, the method comprising:

disposing an active noise control (ANC) module in or adjacent to a ventilation channel of the window, wherein the ANC module is configured to substantially cancel low-frequency noise entering the ventilation channel; and disposing a passive sound absorbing module in or adjacent to the ventilation channel, wherein the passive sound absorbing module is configured to absorb both high-frequency noise entering the ventilation channel and harmonic sounds generated by the ANC module, wherein the ANC module comprises a plurality of multi-cell transparent electroactive film speakers, and wherein disposing the ANC module comprises spatially distributing the speakers at different locations along the ventilation channel.

17. A noise management system for a window, the system comprising:

an active noise control (ANC) module disposed in or adjacent to a ventilation channel of the window and configured to substantially cancel low-frequency noise entering the ventilation channel, the ANC module generating harmonic sounds; and a passive sound absorbing module disposed in or adjacent to the ventilation channel, the passive sound absorbing module comprising a sound absorption coefficient selected to absorb both high-frequency noise entering the channel and the harmonic sounds generated by the ANC module.

18. The noise management as claimed in claim 17, wherein the ANC module and the passive sound absorbing module have a synergistic interaction and the harmonic sounds generated by the ANC module are absorbed by the passive sound absorbing module, such that a total noise mitigation effect is larger than a sum of noise mitigation effects produced by said modules separately.

19. A method of managing noise, comprising:

substantially cancelling low-frequency noise entering a ventilation channel of a window using an active noise control (ANC) module disposed in or adjacent to the ventilation channel;

absorbing high-frequency noise entering the channel using a passive sound absorbing module disposed in or adjacent to the ventilation channel; and absorbing harmonic sounds generated by the ANC module using the passive sound absorbing module, wherein the passive sound absorbing module comprises a sound absorption coefficient selected to absorb both the high-frequency noise entering the channel and the harmonic sounds generated by the ANC module.

20. The method as claimed in claim 19, wherein the ANC module and the passive sound absorbing module have a synergistic interaction and the harmonic sounds generated by the ANC module are absorbed by the passive sound absorbing module, such that a total noise mitigation effect is larger than a sum of noise mitigation effects produced by said modules separately.

* * * * *